United States Patent [19]

Seiler et al.

[11] Patent Number: 4,793,316

[45] Date of Patent: Dec. 27, 1988

[54] FUEL INJECTION PUMP FOR INTERNAL COMBUSTION ENGINES

[75] Inventors: Guenter Seiler; Karlheinz Hoffmann, both of Stuttgart, Fed. Rep. of Germany

[73] Assignee: Daimler-Benz Aktiengesellschaft, Fed. Rep. of Germany

[21] Appl. No.: 938,884

[22] Filed: Dec. 8, 1986

[30] Foreign Application Priority Data

Dec. 13, 1985 [DE] Fed. Rep. of Germany ..... 3544051

[51] Int. Cl.[4] ..... F02N 3//00

[52] U.S. Cl. ..... 123/509; 123/495

[58] Field of Search ..... 123/495, 509, 500, 501, 123/449

[56] References Cited

U.S. PATENT DOCUMENTS

| | | | |
|---|---|---|---|
| 1,778,158 | 10/1930 | L'Orange | 123/495 |
| 2,097,413 | 10/1937 | Hurst | 123/495 |
| 3,714,935 | 2/1973 | Dreisin | 123/501 |
| 4,430,997 | 2/1984 | Shimada | 123/509 |

FOREIGN PATENT DOCUMENTS

| | | | |
|---|---|---|---|
| 2646546 | 4/1978 | Fed. Rep. of Germany | 123/495 |
| 0104765 | 6/1985 | Japan | 123/495 |
| 1245130 | 9/1971 | United Kingdom | 123/509 |

*Primary Examiner*—Carl Stur// Miller

*Attorney, Agent, or Firm*—Barnes & Thornburg

[57] ABSTRACT

The invention relates to a fuel injection pump for internal-combustion engines having element pistons that are arranged in the pump housing and are guided in element sleeves in a longitudinally slidable way, each of said element pistons having a collar with flattened areas that in a torsionally fixed but axially slidable way is guided in a control sleeve that is connected with the control rod of the fuel injection pump and is disposed on the element sleeve so that it can be turned. In order to eliminate the play between the control sleeve and the element piston, a spring is provided between the collar of the element piston and the control sleeve that rests flexibly against it, or the control sleeve is designed to be slotted in such a way that it elastically reaches around the element piston.

14 Claims, 4 Drawing Sheets

FUEL INJECTION PUMP FOR INTERNAL COMBUSTION ENGINES

BACKGROUND AND SUMMARY OF THE INVENTION

The invention relates to a fuel injection pump for internal combustion engines of the type having a cam operated piston element with a control collar surrounded by an adjustable control sleeve for controlling the rotational position of the piston element.

A fuel injection pump of this type is disclosed in German Published Unexamined Patent Application (DE-OS) No. 26 46 546 wherein an element piston is guided in an element sleeve that is provided with a control edge control means and that, at its piston segment projecting out of the element sleeve, has a collar with flattened areas that can be slid in axial direction but is guided in a torsionally fixed way in a control sleeve.

The control sleeve that can be operated by a control rod is disposed so that it turns on the element sleeve and, in the case of a change of load, via the flattened collar, adjusts the element Piston for the purpose of controlling the start of delivery and the delivery rate.

In the case of constructions of this type, the plays caused by manufacturing tolerances between the control sleeve and the collar or so-called element piston lug cause considerable variations of the injected amount that may result in "shaking during idling" and reinforce "urging."

Objectives of the invention are the elimination of the described disadvantages by simple measures that are also advantageous with respect to assembly and are suitable for large-scale production.

These objectives are achieved according to the invention by providing a resilient clamping connection between the control sleeve and the piston control collar. In certain embodiments a separate resilient clamp is interposed between the control collar and the control sleeve. In other preferred embodiments, the control sleeve itself is slotted to form a resilient clamping section. In both cases, the play is eliminated between the element piston and the control sleeve. The measures taken according to the invention for eliminating the play are cost effective and easy to achieve with respect to manufacturing techniques so that they are very well suited for series production.

In one preferred embodiment, the element piston is manufactured as Previously. The control sleeve is only designed to be slotted and subsequently is pressed together by a small amount in such a way that, before the mounting, an elastic overlapping exists between the clear width of the control sleeve and the flattened collar of the element piston.

In the other preferred embodiment, one of the two flattened areas at the collar of the element piston is ground off more, an elastic clamp being inserted between said flattened area and the oppsite side of the control sleeve.

Both embodiments are made to be without Play in the most simple ways. Variations will no longer occur in the characteristic diagram of the injected amount.

Other objects, advantages and novel features of the present invention will become apparent from the following detailed description of the invention when considered in conjunction with the accompanying drawings.

DETAILED DESCRIPTION OF THE DRAWINGS

Figure 1:
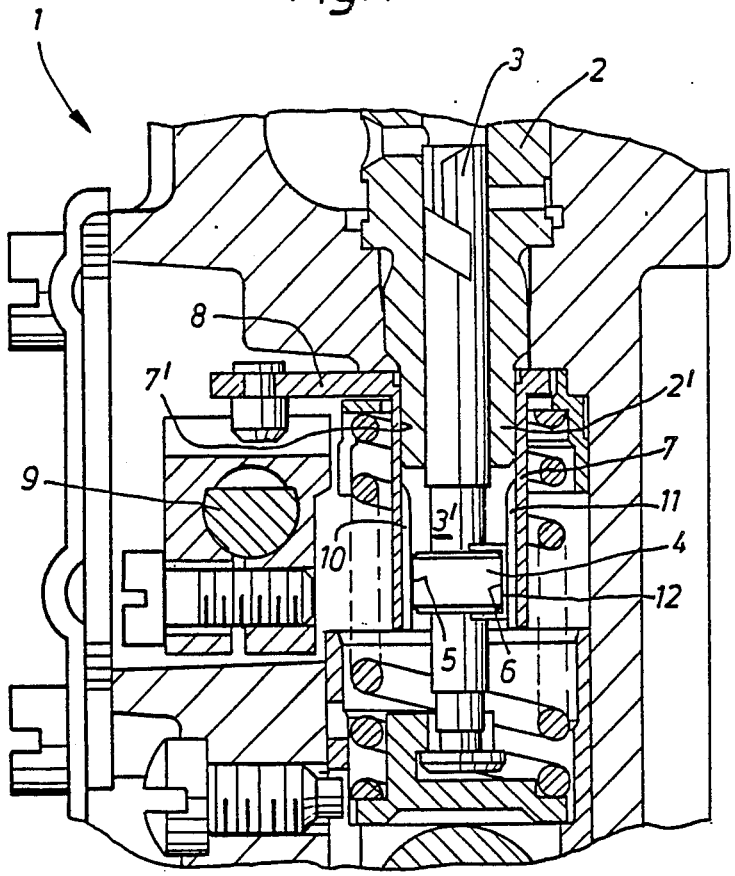
FIG. 1 is a partial, cross-sectional view of a fuel injection pump with an elastic clamp arranged between a control sleeve and the control collar of an element piston constructed in accordance with a Preferred embodiment of the invention.

A series-produced fuel-injection pump 1 intended for air-compressing self-igniting internal-combustion engines comprise element sleeves 2 having element pistons 3 that are guided in them. Piston 3, at its piston segment 3' projecting out of the element sleeve 2, has a control collar 4 with diametrically opposite flattened areas 5, 6, that in a torsionally fixed but longitudinally slidable way, is guided in a control sleeve 7 disposed on the lower segment 2' of the element sleeve 2 so that it can be turned. The control sleeve 7 that has a control lever 8 for the control rod 9 is developed as a sheet steel stamping. Below bearing surface 7' of lleeve 7 there are indentations 10, 11, serving as the opposing side for the flattened areas 5, 6 of the collar 4 (FIG. 1 and FIG. 7).

Figure 2:
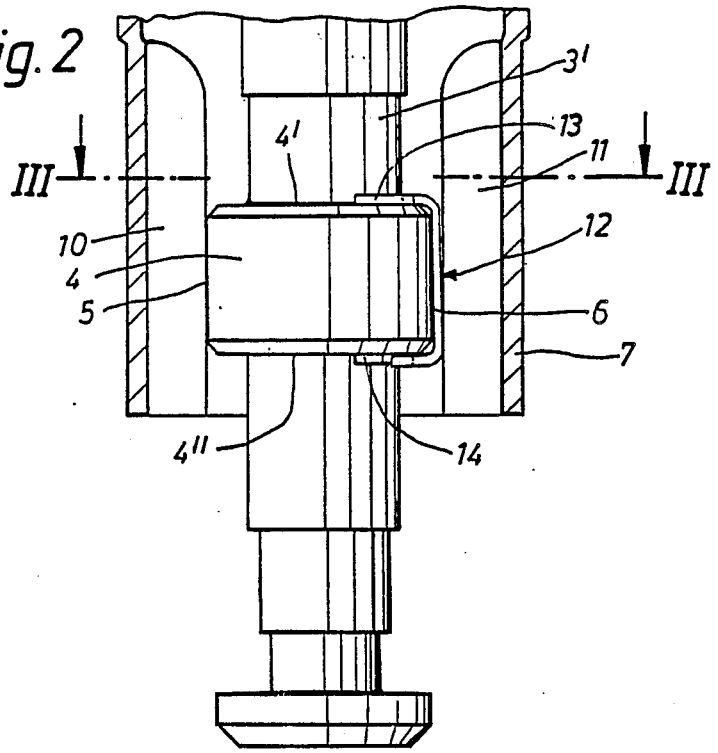
FIG. 2 is an enlarged Partial view showing the clamp arrangement of the embodiment of FIG. 1.

In the case of the embodiment according to FIG. 1, one of the two flattened areas 5, 6 is ground more than the other. Between the larger flattened area that as the reference number 6 and the assigned indentations 11 of the control sleeve 7 (FIG. 3), a U-shaped elastic clamp 12 is located that is adapted to the shape of the flattened collar 4, said clamp 12 being clamped onto the collar radially from the outside (FIG. 2). The legs 13, 14 that rest against the front sides 4', 4'' of the collar under spring-preload, are provided at their ends with arched recesses 15, 16 (FIG. 3, 6), the arches of which correspond approximately to the diameter of the piston segment 3' and extend to close to it, in order to heighten the contact surface or the clamping surface of the clamp 12 in this way.

Figure 3:
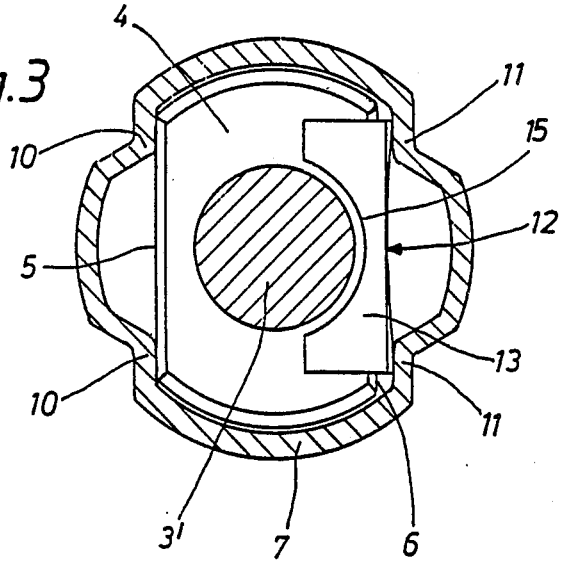
FIG. 3 is an enlarged top part sectional view of the collar of the element piston corresponding to the sectional plane III—III in FIG. 2.
Figure 4:
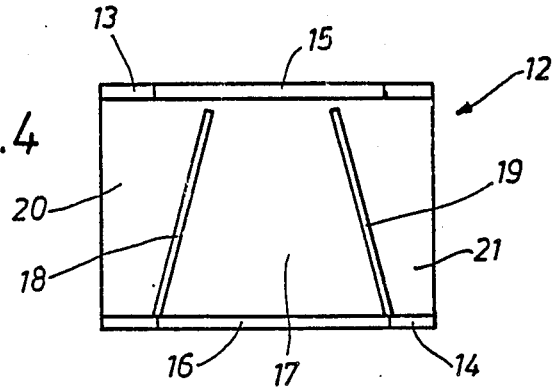
FIG. 4 is an enlarged view of the slotted web of the U-shaped clamp of FIGS. 1–3.
Figure 5:
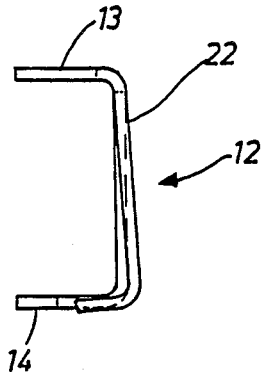
FIG. 5 is an enlarged lateral view of the U-shaped clamp of FIGS. 1–3.
Figure 6:
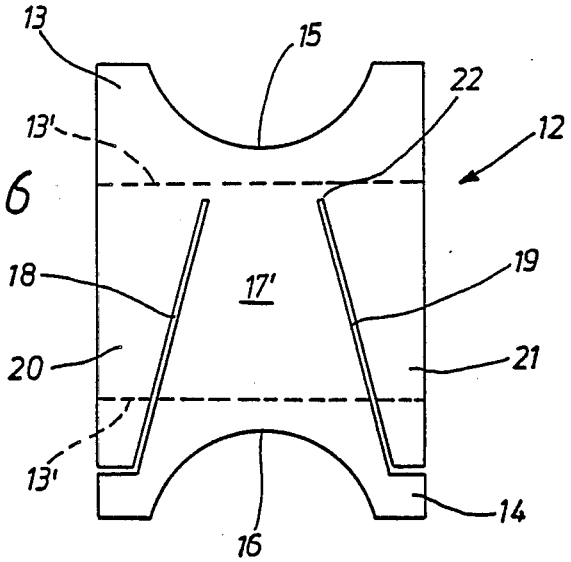
FIG. 6 is an enlarged view of the clamp of FIGS. 1–3, schematically shown in a bent-away condition and also showing a further embodiment of the slot configurations.

The web 17 of the clamp 12 is designed to be slotted in such a way that two slots 18, 19 start at a small distance from the leg 13, follow a diagonal course to the edge of the web and end approximately in the center of the lower leg 14 (FIG. 4, 6). Because of the slots 18, 19, a web part 17' located in the center, and web parts located on the outside as flexible tongues 20, 21, are formed that, because of the course of the slot, taper in downward direction and are pulled away toward the outside (FIG. 5) at a buckling point 22 located just below the upper bending edge 13' where the slots begin. FIG. 3 clearly shows the installed spring clamp 12 with its preloaded flexible tongues 20, 21 supporting themselves at the control sleeve 7. FIG. 6 shows the clamp 12 in a flat unbent condition.

Figure 7:
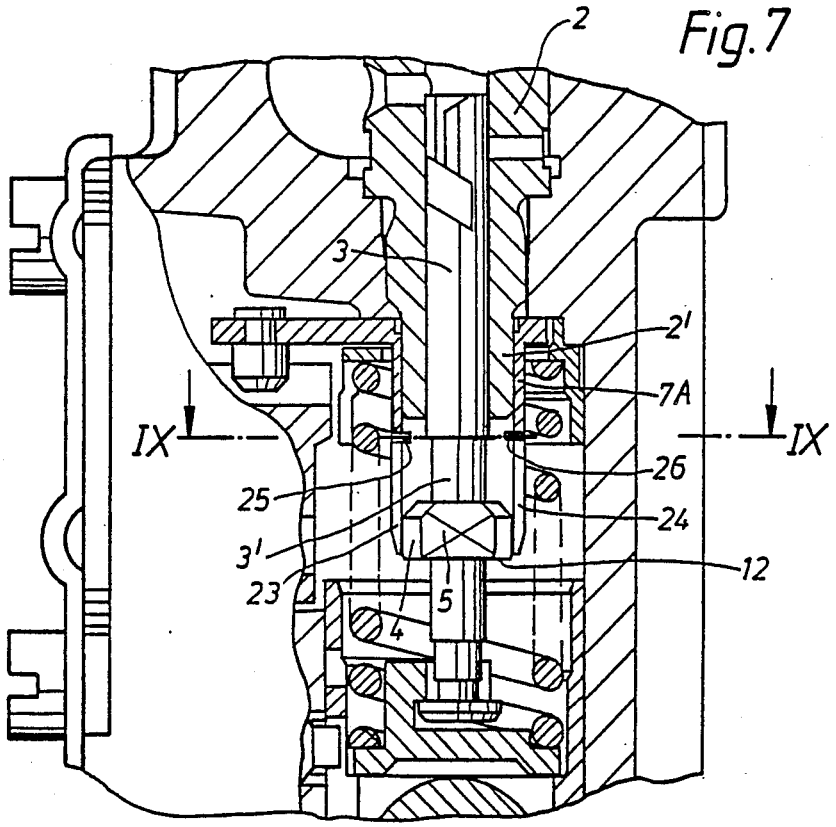
FIG. 7 is a partial cross-sectional view of an injection pump, with a slotted control sleeve constructed in accordance with another preferred embodiment of the invention.
Figure 9:
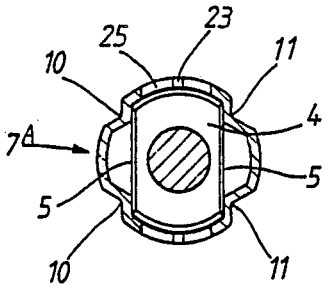
FIG. 9 is a top view of the collar of the element piston corresponding to the sectional plane IX—IX in FIG. 7.
Figure 8:
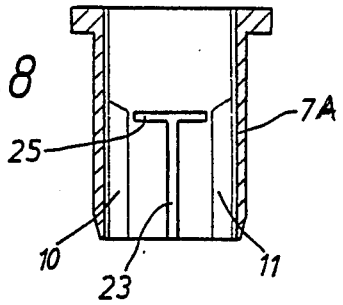
FIG. 8 is a view of the control sleeve, where the slot arrangement is turned by 90° with respect to the control sleeve of FIG. 7.

In the case of the embodiment according to FIG. 7, the collar 4 at the element piston 3 has the same flattened areas 5, 6 except the larger ground area 6 of FIG. 1–6 is not needed for the clamp 12. The control sleeve 7 is also provided with indentations 10, 11 that, however, all serve as a contact or sliding surface for the collar 4. The play between the collar 4 and the control sleeve 7A is eliminated because of the fact that the control sleeve 7A is designed to be slotted. The slot arrangement comprises diametrically opposite longitudinal slots 23, 24 that extend from the lower free end of the control sleeve 7A to approximately the element sleeve 2 as well as of transverse slots 25, 26 that together with respective longitudinal slots 23, 24 result in a T-shape. Each longitudinal and pertaining transverse slot is staggered by 90° with respect to the flattened areas of the collar 4 (FIG. 9).

Before the assembly, the control sleeve in the slot area is pressed radially toward the inside in such a way that the inside diameter is by about 0.1 mm smaller than the diameter of the element Piston collar 4.

In the assembled condition, the slotted control sleeve 7 rests elastically against the collar 4.

In certain preferred embodiments, the control sleeve 7 is made of spring steel in order to improve the spring characteristics.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed:

1. A fuel injection pump arrangement comprising:
movable piston means having a control collar means with control surface means
adjustable control sleeve means engageable with the control surface means for controlling the rotative position of the piston means,
and resilient clamping means for limiting play between the control collar means and the control sleeve means,
wherein said resilient clamping means is a clamping member separated from the control sleeve means, and clamping member being disposed between the control sleeve means and control collar means.

2. A fuel injection pump arrangement according to claim 1, wherein said clamping member is a U-shaped member which clampingly engages over the control collar means and is slotted to form flexible resiliently preloaded tongues which abut against one of the control sleeve means and control collar means.

3. A fuel injection pump arrangement according to claim 2, wherein the web of the U-shaped member is provided with a plurality of slots.

4. A fuel injection pump arrangement comprising:
movable piston means having a control collar means with control surface means
adjustable control sleeve means engageable with the control surface means for controlling the rotative position of the piston means,
and resilient clamping means for limiting play between the control collar means and the control sleeve means,
wherein said resilient clamping means includes slotted means.

5. A fuel injection pump arrangement comprising:
movable piston means having a control collar means with control surface means
adjustable control sleeve means engageable with the control surface means for controlling the rotative position of the piston means,
and resilient clamping means for limiting play between the control collar means and the control sleeve means,
wherein said resilient clamping means includes portions of the control sleeve means that are resiliently preloaded.

6. A fuel injection pump arrangement according to claim 5, wherein said elastically preloaded portions of the control sleeve means are formed by slotted sections of the control sleeve means.

7. A fuel injection pump arrangement according to claim 6 wherein said slotted sections are formed by T-shaped slots.

8. A fuel injection pump for internal combustion engines having element sleeves that are arranged in the pump housing, of which each receives an element piston that is driven by a camshaft and has a control edge and is provided with a collar with diametrically opposite flattened areas, and having a control sleeve that is disposed so that it can be turned on the lower part of the element sleeve facing the camshaft and is connected with a control rod, said control sleeve having indentations below the element sleeve to serve as the opposite side for the flattened areas of the collar for the purpose of preventing a turning motion, wherein the flattened areas at the collar of the element piston are ground to a varying degree and an elastic clamp is provided between the more ground flattened surface and the indentations facing it in order to bring the opposite flat area into a play-free contact with the indentations assigned to it.

9. A fuel injection pump according to claim 8, wherein the clamp is U-shaped and has bent-away legs resting under preload, on axially facing ends of the collar and a web having slots extending in the axial direction of the element piston, said slots dividing the web into three web parts, of which the exterior web parts resting under preload against the indentations of the control sleeve form flexible tongues.

10. A fuel injection pump according to claim 9, wherein the flexible tongues extend into a leg, said flexible tongues in the web area adjacent to said leg projecting the farthest from the flattened area.

11. A fuel injection pump according to claim 10, wherein the free leg ends have circular recesses adapted to the diameter of the element piston, in such a way that the leg ends reach approximately around half the side of the element piston.

12. A fuel injection pump for internal combustion engines having element sleeves that are arranged in the pump housing, of which each receives an element piston that is driven by a camshaft and has a control edge and is provided with a collar with diametrically opposite flattened areas, and having a control sleeve that is disposed so that it can be turned on the lower part of the element sleeve facing the camshaft and is connected with a control rod, said control sleeve having indentations below the element sleeve to serve as the opposite side for the flattened areas of the collar for the purpose of preventing a turning motion, wherein the control sleeve is provided with longitudinal slots extending between the diametrically opposite indentations over their length, and wherein the inside diameter of the control sleeve in the slot area, by means of a radial inward compression before the assembly, is smaller than the diameter of the collar at the element piston.

13. An injection pump according to claim 12, wherein each longitudinal slot extends from the lower free end of the control sleeve to a transverse slot extending to just below the element sleeve.

14. An injection pump according to claim 12, wherein the control sleeve consists of spring steel.

* * * * *